US010369081B2

(12) United States Patent
Hines

(10) Patent No.: US 10,369,081 B2
(45) Date of Patent: Aug. 6, 2019

(54) LOADING AN AUTOMATED MEDICATION DISPENSER

(71) Applicant: Dose Health, LLC, Maple Grove, MN (US)

(72) Inventor: Paul Hines, Minneapolis, MN (US)

(73) Assignee: Dose Health, LLC, Maple Grove, MN (US)

( * ) Notice: Subject to any disclaimer, the term of this patent is extended or adjusted under 35 U.S.C. 154(b) by 107 days.

(21) Appl. No.: 15/707,996

(22) Filed: Sep. 18, 2017

(65) Prior Publication Data

US 2018/0064608 A1 Mar. 8, 2018

Related U.S. Application Data

(63) Continuation-in-part of application No. 29/563,171, filed on May 3, 2016, now Pat. No. Des. 806,380.

(60) Provisional application No. 62/396,150, filed on Sep. 17, 2016.

(51) Int. Cl.

| | |
|---|---|
| ***A61J 7/04*** | (2006.01) |
| ***A61J 7/00*** | (2006.01) |
| ***G07F 17/00*** | (2006.01) |

(52) U.S. Cl.

CPC ..... *A61J 7/049* (2015.05); *A61J 7/0084* (2013.01); *A61J 7/0092* (2013.01); *A61J 7/0418* (2015.05); *A61J 7/0481* (2013.01); *G07F 17/0092* (2013.01); *A61J 7/0069* (2013.01); *A61J 7/0076* (2013.01); *A61J 7/0427* (2015.05); *A61J 2200/70* (2013.01); *A61J 2200/74* (2013.01)

(58) Field of Classification Search

None

See application file for complete search history.

(56) References Cited

U.S. PATENT DOCUMENTS

| | | | | |
|---|---|---|---|---|
| 4,572,403 | A * | 2/1986 | Benaroya | A61J 7/04 221/15 |
| 6,611,733 | B1 | 8/2003 | De La Huerga | |
| 6,766,219 | B1 | 7/2004 | Hasey | |
| 7,044,302 | B2 | 5/2006 | Conley | |
| 9,278,053 | B2 | 3/2016 | Moore | |
| 2003/0127463 | A1* | 7/2003 | Varis | A61J 7/0084 221/2 |
| 2004/0182873 | A1* | 9/2004 | Baum | A61J 7/0481 221/15 |
| 2009/0281657 | A1* | 11/2009 | Gak | A61J 7/0481 700/242 |
| 2010/0121486 | A1* | 5/2010 | Yuyama | G07F 11/44 700/227 |
| 2010/0305749 | A1* | 12/2010 | Coe | A61J 7/0481 700/231 |
| 2013/0018503 | A1* | 1/2013 | Carson | B65B 57/16 700/216 |
| 2013/0297068 | A1 | 11/2013 | Marshall | |
| 2014/0278510 | A1 | 9/2014 | McLean | |

(Continued)

*Primary Examiner* — Timothy R Waggoner

(74) *Attorney, Agent, or Firm* — Patterson Thuente Pedersen, PA

(57) ABSTRACT

Concepts presented herein relate to approaches for loading a medication dispenser. In one aspect, a medication schedule is obtained and compartments for medication to be positioned in the medication dispenser are identified. A particular medication is selected to be loaded and an indication is provided of the compartment that will hold the particular medication.

14 Claims, 11 Drawing Sheets

(56) References Cited

U.S. PATENT DOCUMENTS

| | | | | |
|---|---|---|---|---|
| 2017/0021950 | A1* | 1/2017 | Bouthiette | A61J 1/035 |
| 2017/0326033 | A1 | 11/2017 | Kraft | |
| 2017/0348194 | A1* | 12/2017 | Duda | A61J 7/0084 |

* cited by examiner

LOADING AN AUTOMATED MEDICATION DISPENSER

CROSS REFERENCE TO RELATED APPLICATIONS

This application claims the benefit of U.S. Provisional App. Ser. No. 62/396,150, filed filed Sep. 17, 2016, and is further a continuation in part of U.S. patent application Ser. No. 29/563,171, filed May 3, 2016, the contents of both of the aforementioned applications being hereby incorporated by reference in their entirety. This application is further related to co-pending U.S. patent application Ser. No. 15/707,858, filed on even date herewith, the contents of which are hereby incorporated by reference in their entirety.

BACKGROUND

Compartments in current medication dispensers are associated with a discrete time of the day that one or more medications in the compartments are taken. For example, if a person is taking a medication twice per day, two compartments are used, one for each time the medication is intended to be taken. In current rotary medication dispensers, compartments are presented one at a time in a sequential order. If there are 14 compartments, for example, and if the aperture is exposing compartment 7, then at the next medication dispensing time, the aperture would expose the adjacent compartment 8 and so on. In order to avoid taking the wrong medication, this dispenser must be filled with an understanding of the operation of the dispenser such that desired medications are dispensed at the correct time.

Current medication dispensers are accordingly loaded differently depending on when the medication is loaded. For example, if a dispenser is loaded after the first time medications are taken during the day, then the dispenser must be loaded with the knowledge that these medications have been taken. If a user of the dispenser is unaware of what medications have been taken, a point of failure is introduced in loading the desired medication.

SUMMARY

Concepts presented herein relate to approaches for loading a medication dispenser. In one aspect, a medication schedule is obtained and compartments for medication to be positioned in the medication dispenser are identified. A particular medication is selected to be loaded and an indication is provided of the compartment that will hold the particular medication.

DESCRIPTION

Figure 1:
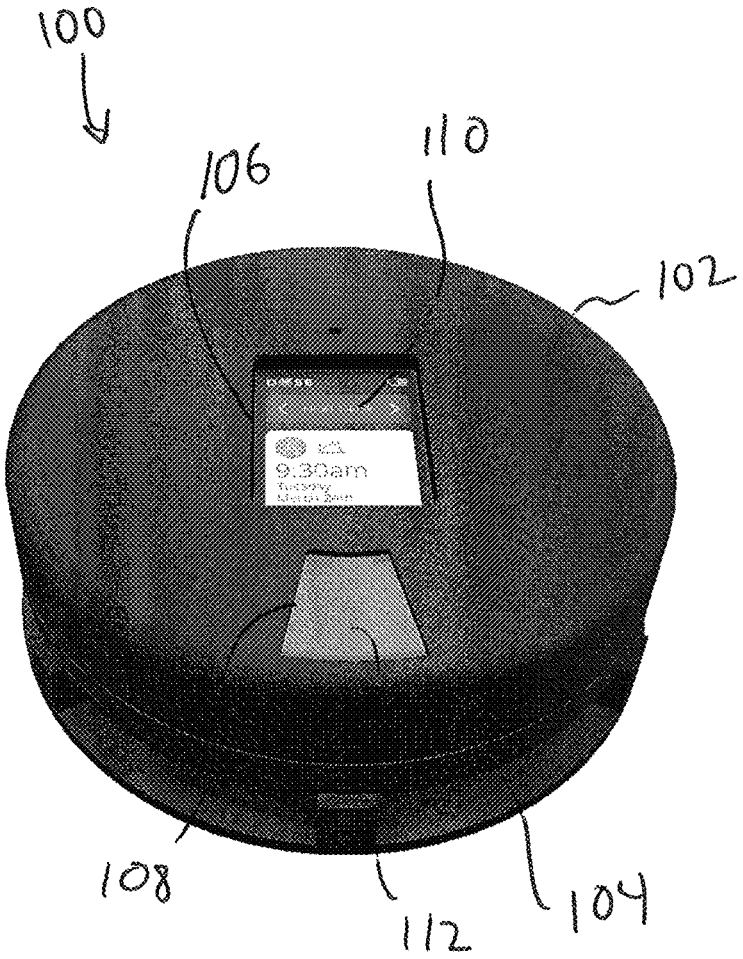
FIG. 1 is a perspective view of a medication dispenser.
Figure 2:
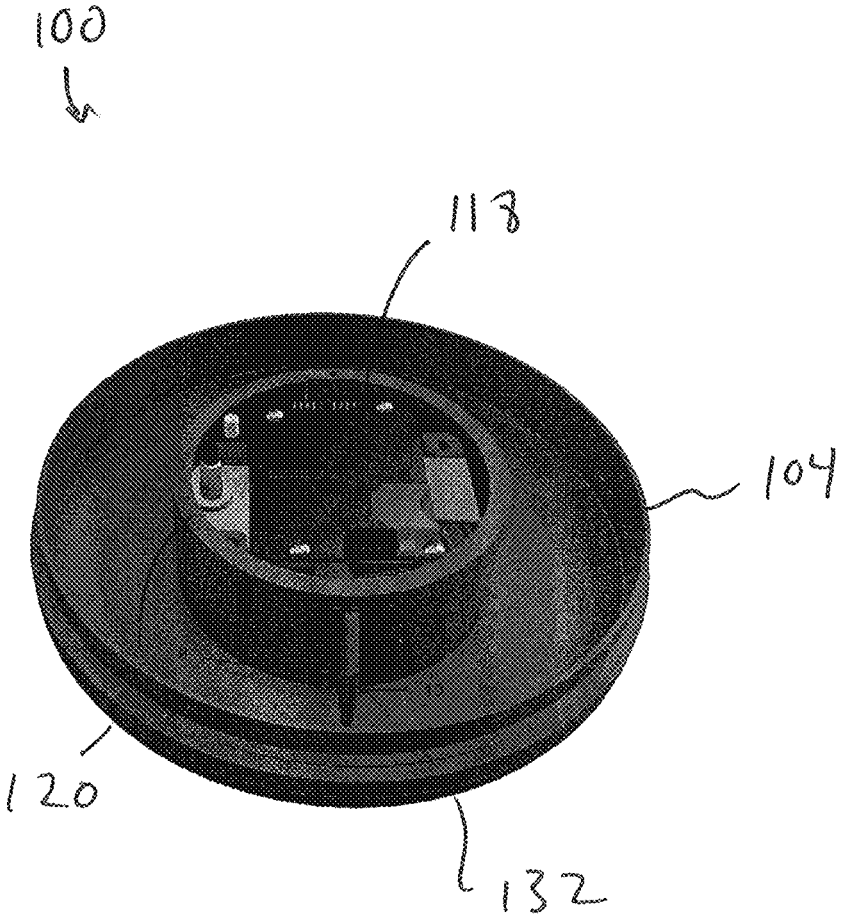
FIG. 2 is a perspective view of the medication dispenser of FIG. 1 with portions removed to illustrate a control assembly and drive member.
Figure 3A:
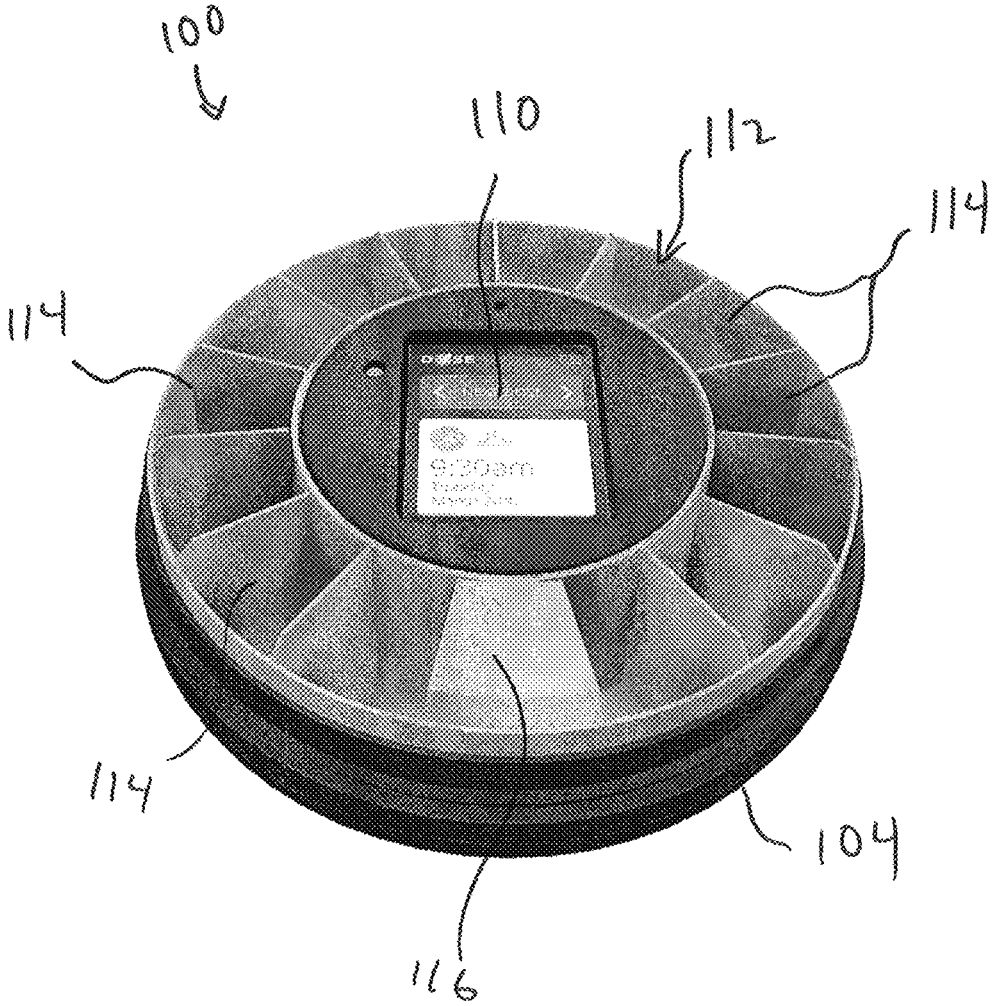
FIG. 3A is a top perspective view of the medication dispenser of FIG. 1 with a cover removed to illustrate a cassette.
Figure 3B:
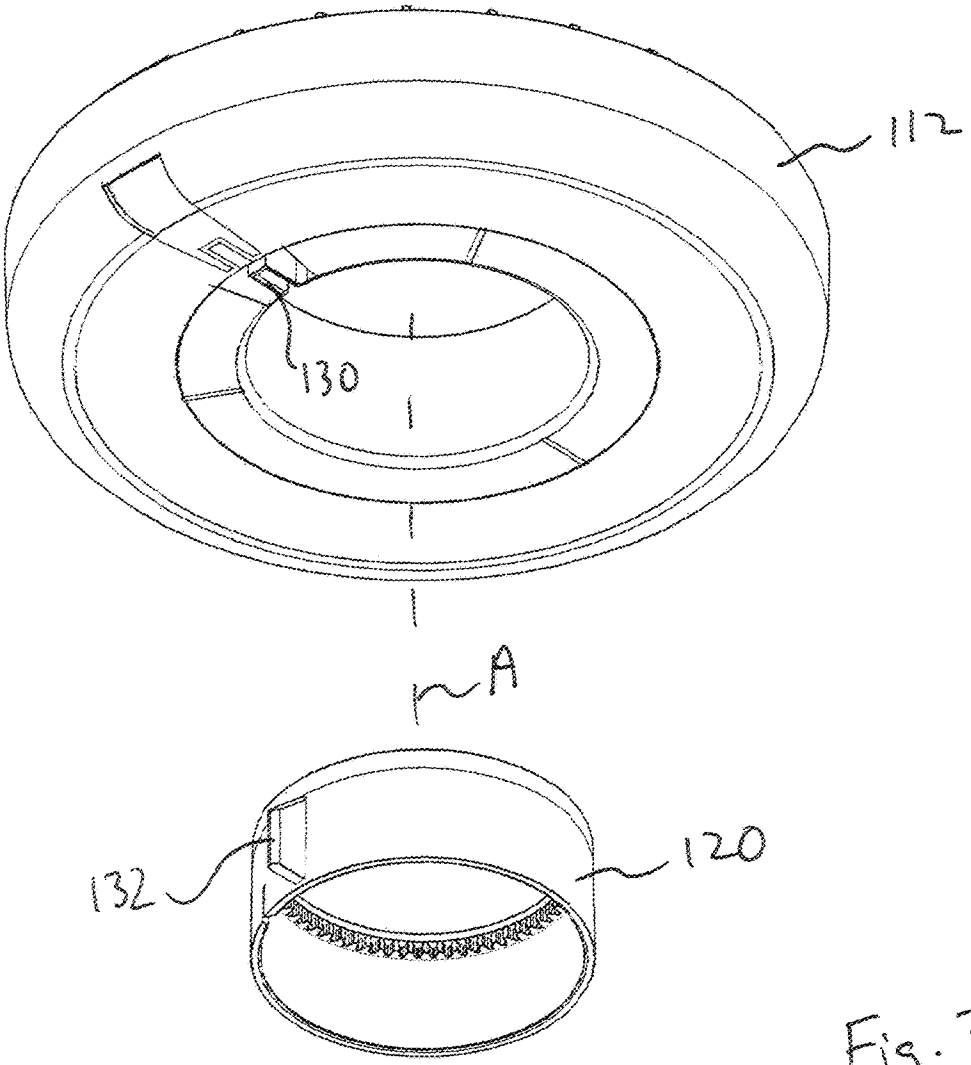
FIG. 3B is a bottom perspective view of a cassette and a drive member of the medication dispenser of FIG. 1.
Figure 4:
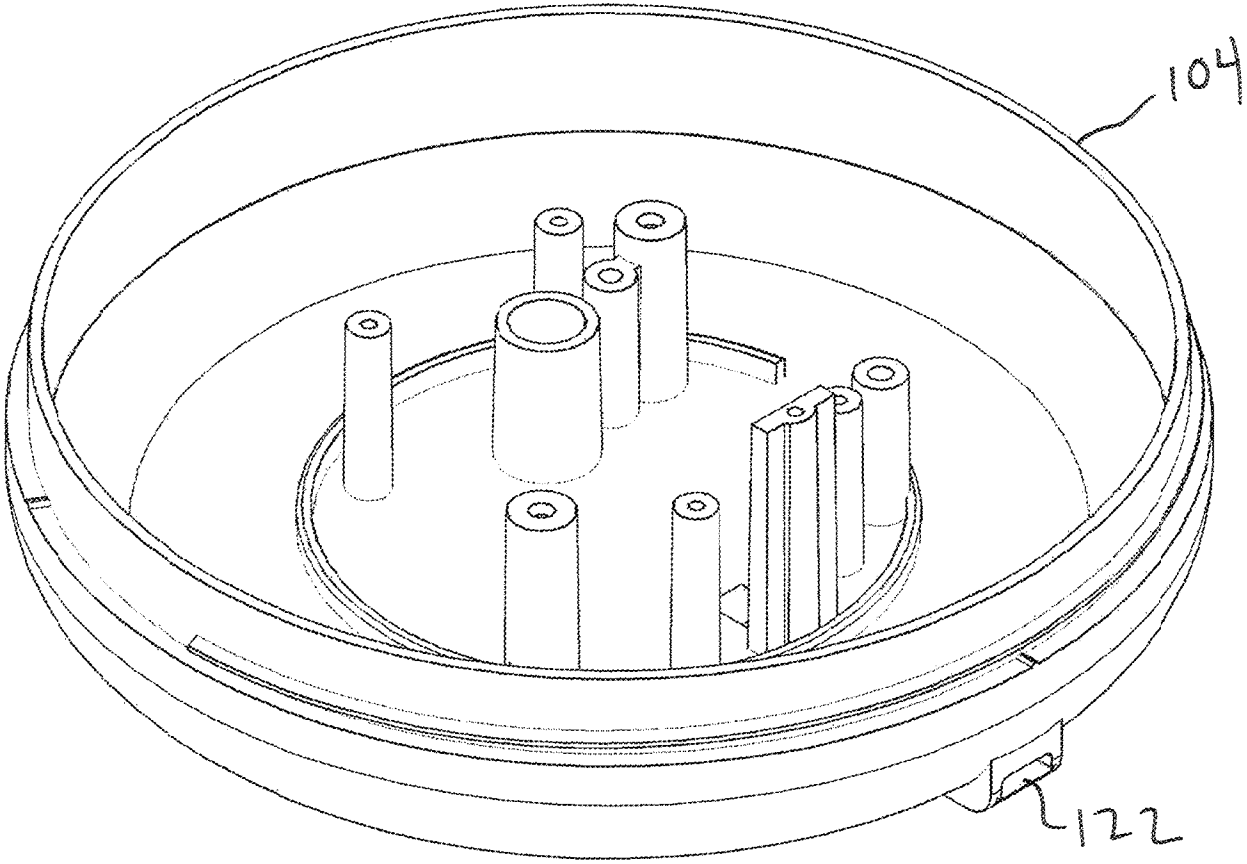
FIG. 4 is a rear perspective view of a base of the medication dispenser of FIG. 1.

FIGS. 1-4 illustrate medication dispenser 100, which includes a cover 102 mounted to a base 104. The cover 102 includes a first aperture 106 and a second aperture 108. Aligned with the first aperture 106 is a display screen 110, while the second aperture is aligned with a cassette 112. The cassette 112 includes a plurality of compartments 114A-N as well as a covered compartment 116. Cassette 112 rotates about a central axis A as operated through a control assembly 118 and a drive member 120. In one embodiment, the cassette 112 interfaces with the drive member 120 to rotate therewith about the central axis A. Accordingly, display screen 110 intersects central axis A and, in one particular embodiment, is positioned such that a planar surface of display screen 110 is perpendicular to axis A. A port 122 is provided in the base 104 that is in electrical communication with the control assembly 118 so as to provide power thereto.

The control assembly 118 is operatively coupled with the display screen 110 and drive member 120. The display screen 110, in one embodiment, is a touch screen that receives input from a user and displays information related to loading and operation of the medication dispenser 100. The drive member 120 is coupled with a motor (not shown) of the control assembly 118 to rotate about the central axis A. During operation, as directed by the control assembly 118, the drive member 120 is coupled with the cassette 112 to rotate the cassette 112 about the central axis in order to align one of the plurality of compartments 114 with aperture 108. After aligning one of the plurality of compartments 114 with the aperture 108, drive member 120 can rotate cassette 112 to expose filled compartment 116.

The drive member 120 is thus configured to rotate the cassette 112 to a plurality of discrete positions about the central axis A and relative to the screen 110. In the illustrated embodiment, the cassette 112 includes 15 discrete positions about the central axis, one for each compartment 114 and one for the covered compartment 116. In order to locate the cassette 112 relative to the drive member 120, a slot 130 is positioned within the cassette 112. The slot 130 cooperates with a corresponding projection 132 such that, upon rotation of the drive member 120, cassette 112 rotates therewith. The control assembly 118 includes at least one processor and memory to store information regarding the cassette 112 as well as medication to be dispensed according to a medication schedule.

In one embodiment, the cassette 112 includes a home or reference position relative to the display screen 110. For example, the reference position can be selected as that position where covered compartment 116 is exposed relative to the second aperture 108. Control assembly 118 maintains the position of the cassette 112 in memory so as to be able to instruct a person loading dispenser 100 on the display screen 110 into which compartment 114 a selected medication should be loaded. Using the control assembly 118, the display screen 110 is configured to display information about each of the plurality of compartments 114, including an identifier for each compartment in immediate proximity to each compartment. During loading of the dispenser 100, the identifier for each compartment can be highlighted or otherwise provide an indication of medication to be positioned within the adjacent compartment.

Current dispensers can cause an error if a cassette is loaded after medication has been dispensed and the status of a compartment is unknown. Dispenser 100, using control assembly 118, can assist in ensuring cassette 112 is loaded in a consistent manner, regardless of the time a day the cassette 112 is loaded. To this end, the control assembly 118 can store a number of times that medications are taken throughout a day as well as a status (e.g., loaded, empty) of medication within each compartment 114. In the event medications are taken 3 times a day, control assembly 118 can be configured to ensure a 14 compartment cassette would always be filled with day 1 of a cycle dedicated to compartments A, B and C (e.g., A being dedicated to morning medications, B being dedicated to noon or midday medications and C being dedicated to evening medications), day 2 of a cycle dedicated to compartments D, E, and F, day 3 of a cycle dedicated to compartments G, H and I and day 4 of a medication cycle dedicated to compartments J, K and L. If desired, compartments M and N can also be utilized as dictated by control assembly 118. In another embodiment, compartments M and N can be skipped altogether. Using information from a medication schedule, dispenser 100 can automatically bypass a compartment if the compartment contains medication that is not the correct one to be dispensed.

In another example, in a 14 compartment cassette where medications are taken twice a day, compartments A and B can be dedicated to the first day of a medication cycle, compartments C and D being dedicated to the second day of a medication cycle and so on, with compartments M and N being dedicated to the seventh day of a medication cycle. In this example, compartment A is dedicated to morning medication and compartment B is dedicated to evening medication and further compartments are dedicated to a particular time of the day accordingly.

To dispense medication, the control assembly 118 operates drive member 120 to present a particular compartment through aperture 108 upon a selected time according to a medication schedule. Various approaches can be used to determine if medication has been taken. For example, the control assembly 118 can include an accelerometer and/or weight sensor to determine if dispenser 100 has been flipped over or if medication is no longer present within a selected compartment. In one embodiment, if medication has not been taken within a selected time interval after being presented through aperture 108, the control assembly 118 can operate drive member 120 to expose filled compartment 116 and keep the remaining compartments under cover 102. When dispenser 100 determines that medication has been taken, the status of the particular compartment can be updated to "empty" or an equivalent status identifier.

To prevent exposing medications within a compartment during rotation of cassette 112, dispenser can use an accelerometer or other mechanism to ensure that the aperture 108 is facing upright while rotating. In the embodiment illustrated, medication is difficult to remove without inverting the dispenser 100. Accordingly, unwanted access to medications as the cassette 112 rotates can be prevented.

Figure 5:
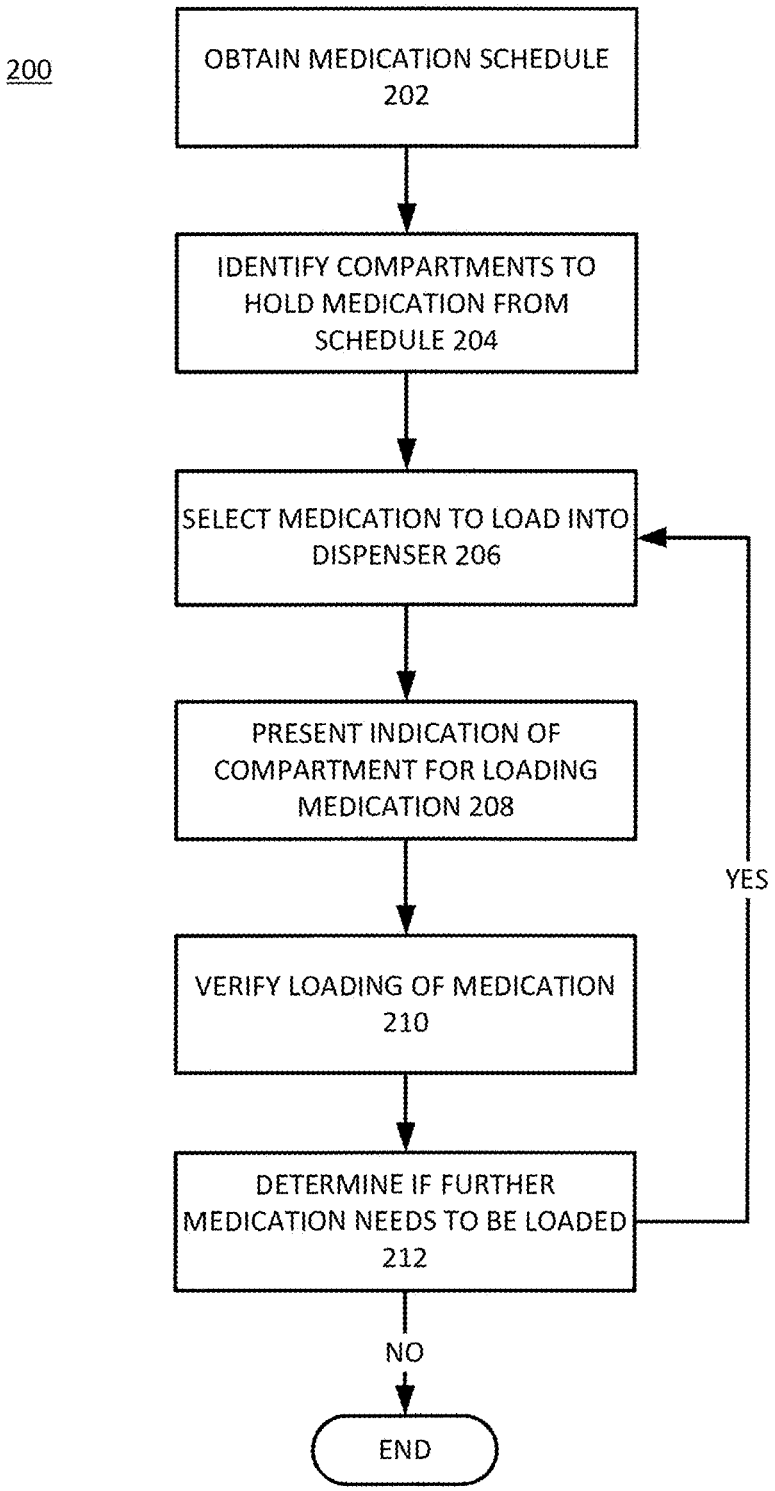
FIG. 5 is a flow diagram of a method of filling a medication dispenser.

FIG. 5 is a flow diagram of a method 200 for loading a medication dispenser such as medication dispenser 100 illustrated in FIG. 1. In one embodiment, dispenser 100 can include a sensor to detect when the cover 102 has been removed from the base 104. In this embodiment, the dispenser 100 can begin method 200 to facilitate loading of the cassette 112. At step 202, a medication schedule is obtained that identifies medications that are to be taken and a time that each medication should be taken. In one embodiment, the control assembly 118 includes memory and one or more communication interfaces (e.g., cellular, WiFi) in order to communicate with a remote computer (not shown) and obtain the medication schedule. As discussed above, the memory can further store a current status for each compartment indicating whether medication is present in each compartment. Next, at step 204, compartments that hold the medication from the medication schedule are identified. Based on the medication schedule, a particular medication is selected to be loaded at step 206. At step 208, an indication of individual compartments to be loaded is presented for the particular selected medication. In one embodiment, this step involves aligning one or more individual compartments with an aperture of the medication dispenser. In another embodiment, an icon or other indicia is presented on a display screen in close proximity to the individual compartment(s) to be loaded. In yet a further embodiment, the indication involves operating a loading mechanism to be aligned with the individual compartments.

Once the medication is loaded into the individual compartments, the loading of the compartments is verified at step 210. The verification can take many forms such as acknowledgement from a user through a user interface or through a sensor (e.g., a weight sensor, optical sensor or the like) that determines presence of medication within the compartments. In order verify if the right medications are present in the cassette 112, a suitable weight sensor can be used to determine total weight of medication that is loaded to the cassette 112. For example, a series of sensors placed underneath cassette 112 could be used to determine the weight of medication loaded into the cassette. As medication is loaded into the cassette 112, the change in weight with each medication could be recorded and compared to an expected weight from a database of medications to determine if the correct medication was loaded. If there were any deviations from the expected weight, a notification can be sent of the possible error and additional checks can be enforced. After verification, method 200 proceeds to step 212, where it is determined if other medications need to be loaded. If further medications need to be loaded, method 200 returns to step 206 to select the further medications. If all the medications are loaded, method 200 ends.

The method 200 can end, in one embodiment, when the cover 102 is positioned on the base 104. After the cover 102 is positioned on base 104, the dispenser operates to dispense medication according to the medication schedule. Dispensing can be performed depending on a time of day that method 200 is complete. For example, if method 200 is performed after morning medications have been dispensed, dispenser 100 is operated to next dispense afternoon medications. In one embodiment, method 200 can be performed at a pharmacy or medication refilling center wherein a known medication schedule is utilized and a loaded cassette 112 is sent to an end user. In another embodiment, the cassette 112 is loaded by a user or a caretaker. In any event, the cassette 112 can be consistently loaded and include the same medications in the same compartment.

Figure 6:
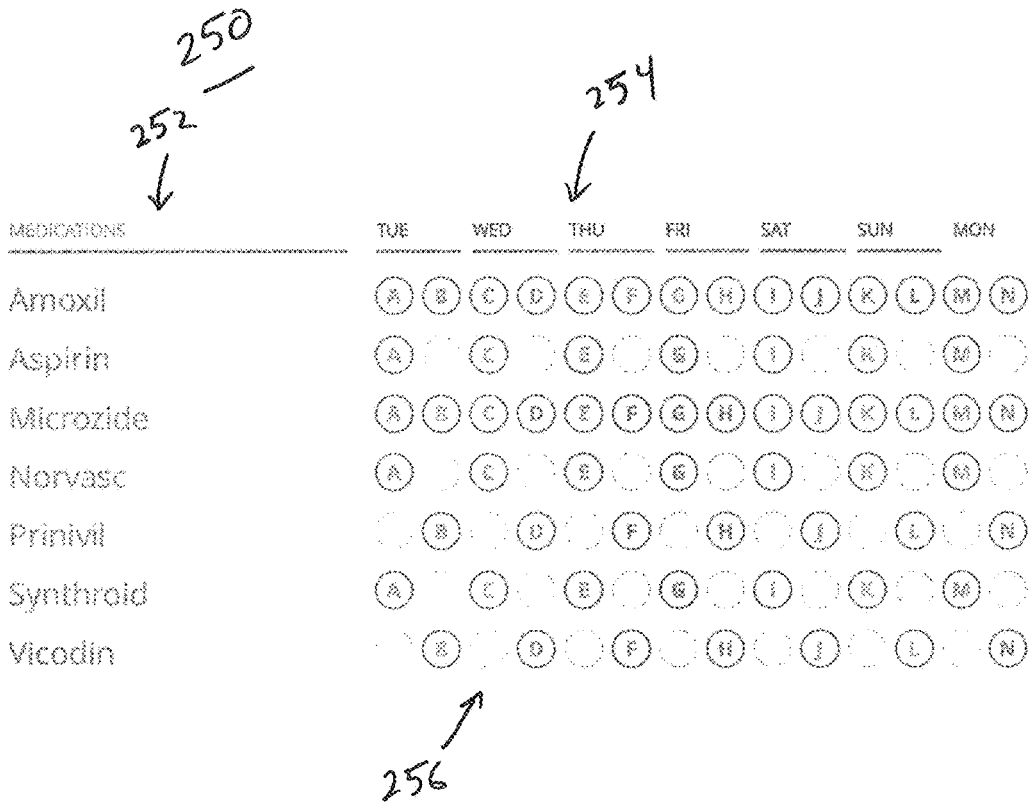
FIG. 6 is a schematic diagram of a medication schedule.

FIG. 6 is a schematic screen display of an example medication schedule 250. In one embodiment, the medication schedule 250 can be displayed on a display screen communicatively coupled with the medication dispenser 110 to assist in loading the dispenser 100. The medication schedule 250 includes a medication list 252, a timing indication section 254 and a compartment identification section 256. Medication list 252 identifies medications to be taken for a user of the dispenser 100. The timing indication section 254 lists various times through the week to dispense the medications identified in the medication list 252. The timing section 254 as illustrated includes days of the week, but can be adjusted to represent other time frames as desired. The compartment identification section 256 identifies the compartments 112A-N within the cassette 112 of the dispenser 100. In particular, the compartment identification section 256 can identify whether a selected medication within medication list 252 should be positioned within a particular compartment.

In order to adapt to varying medications schedules (once a day versus twice a day, etc.) general labelling (herein embodied as letters A-N) for a 14 compartment cassette can be used. The general labelling can further be associated with a dynamic guide (e.g., printed on paper, displayed on a computer screen communicatively coupled with the dispenser 100 or directly on display screen 110) that identifies what medications go into what labelled compartment. Further still, labelling for each compartment can be positioned directly on the cassette 112.

With particular reference to medication schedule 250, for the medication "Amoxil", each of the compartments A-N are highlighted in the compartment section 256. Accordingly, when loading the dispenser 100 with Amoxil, an indication can be provided to loading of Amoxil within each compartment. Alternatively, with respect to the medication "Aspirin" in medication list 252, every other compartment is highlighted, namely, compartments A, C, E, G, I, K and M. When loading the dispenser 100 with Aspirin, an indication can be provided to only load Aspirin within these identified compartments. Accordingly, errors in medication loading can be reduced as the cassette is loaded consistently regardless of a time that the cassette is loaded.

Figure 7:
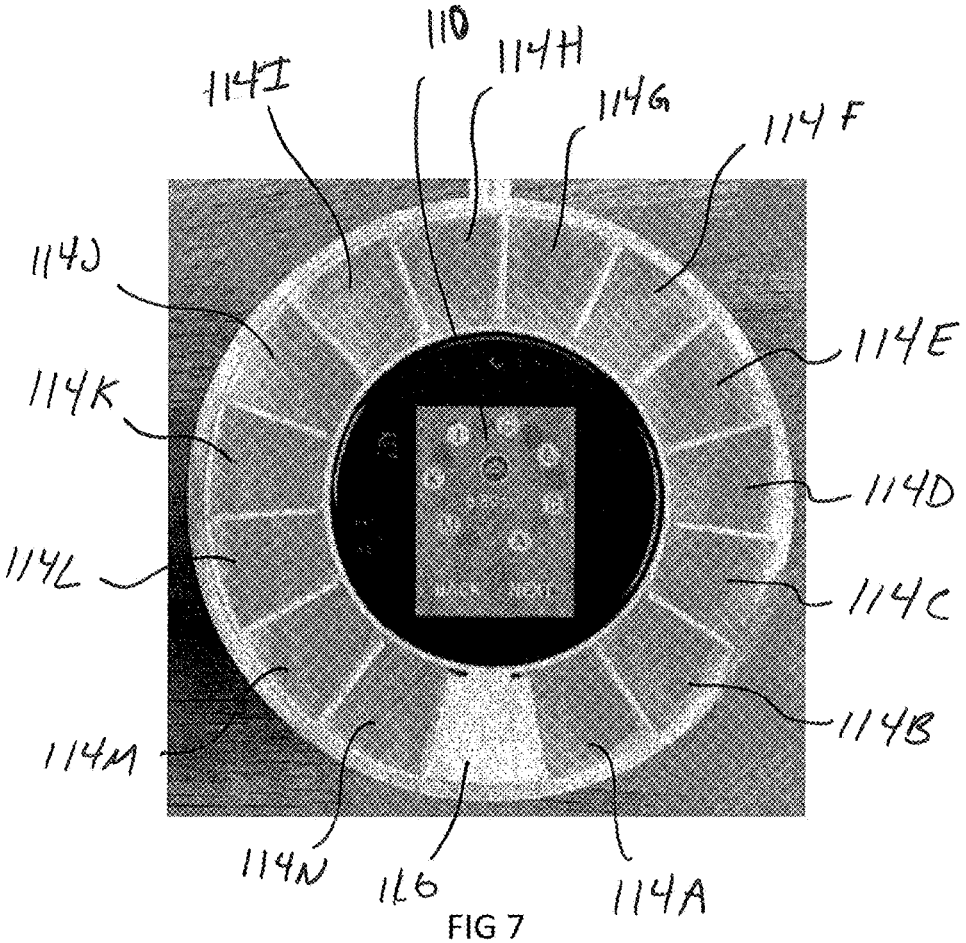
FIG. 7 is a top plan view of a medication dispenser with a display screen displaying a representation of adjacent compartments.

With reference to FIG. 7, display screen 110 can present a representation of the cassette 112, for example by providing an indication for each compartment as shown as well as if a selected medication should be positioned within the compartment. In the embodiment illustrated, compartments 114A, C, E, G, I, K and M are highlighted, whereas compartments 114B, D, F, H, J, L and N are provided with a separate, non-distinct indication (herein being grayed out). In this embodiment, the display screen 110 intersects the axis of rotation for the cassette 112 and provides an adjacent indication of a compartment and whether or not medication should be positioned within the compartment. In addition, the display screen 110 can provide additional information, for example an icon indicating a time of day (e.g., a specified time, morning, day, night) for selected medication. In further embodiments, storing information about a status of each compartment within control assembly 118 can provide additional assistance with loading the dispenser 100. In further embodiments, other indicators can be used. For example, lights under each compartment could indicate what medication goes to what compartment by lighting up the respective compartment for each medication. Additionally, if a status of a particular compartment is identified as loaded, display screen 110 can gray out or otherwise indicate to a user to not load a particular compartment with medication.

Figure 8:
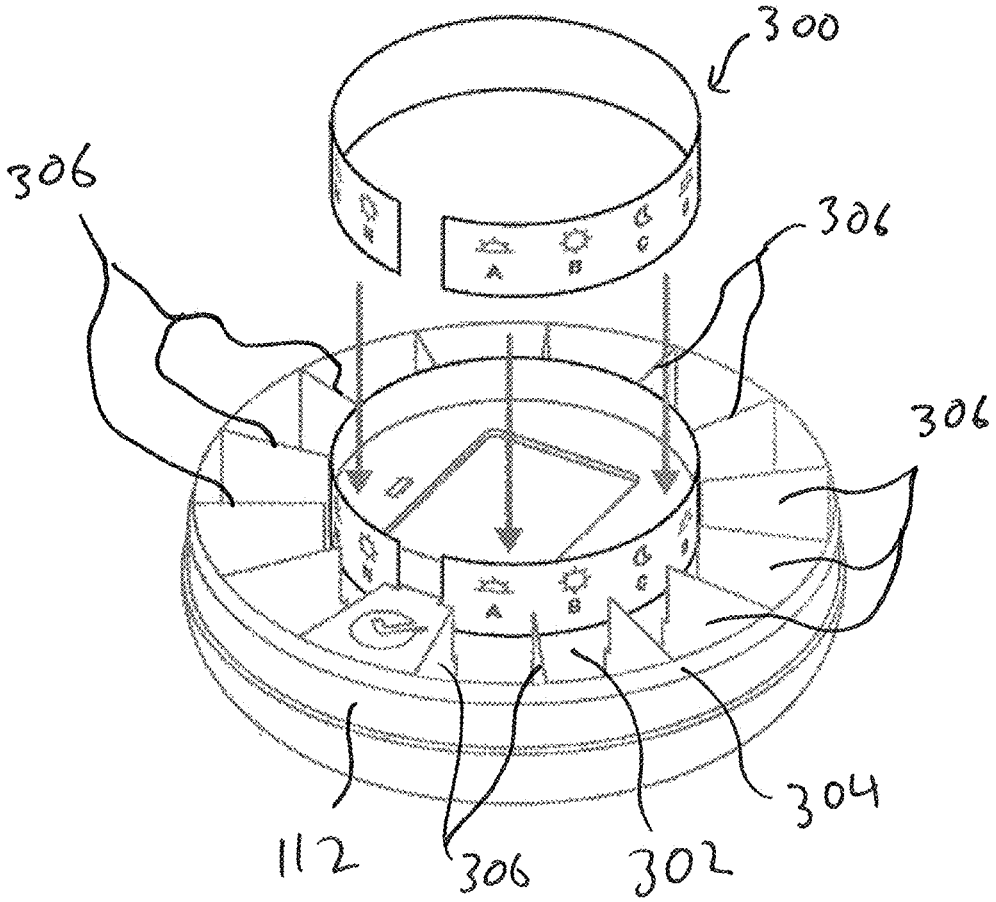
FIG. 8 is a perspective view of a cassette and a ribbon positioned within the cassette to label adjacent compartments.

In addition to the indicators positioned on display screen 110, various other mechanisms can be used to assist in loading cassette 112. In FIG. 8, a ribbon 300 with indicia can be positioned within the cassette 112. The ribbon 300 can include a compartment label (e.g., A, B and so on) as well as an icon indicating a time of day (e.g., morning, noon, evening). As illustrated, the cassette 112 is formed of an inner ring 302 spaced apart from an outer ring 304 with a plurality of sidewalls 306 extending from the outer ring 304 to the inner ring 302. To accommodate the ribbon 300, a slot 308 can be formed about an outer circumference of the inner ring 302 of the cassette 112. By providing slot 308 (as formed by providing a space between an end of each sidewall and the inner ring 302), a person is able to easily insert a ribbon with the indicia around the inner ring 302 of the cassette 112. In one embodiment, the ribbon 300 can be customized as desired. A width of slot 308 can be selected to be wide enough to accommodate ribbon 300, but narrow enough to prevent medication from crossing between compartments. In a further embodiment, an adhesive can be applied to the ribbon 300 to maintain the ribbon 300 in a position with respect to the cassette 112.

Figure 9:
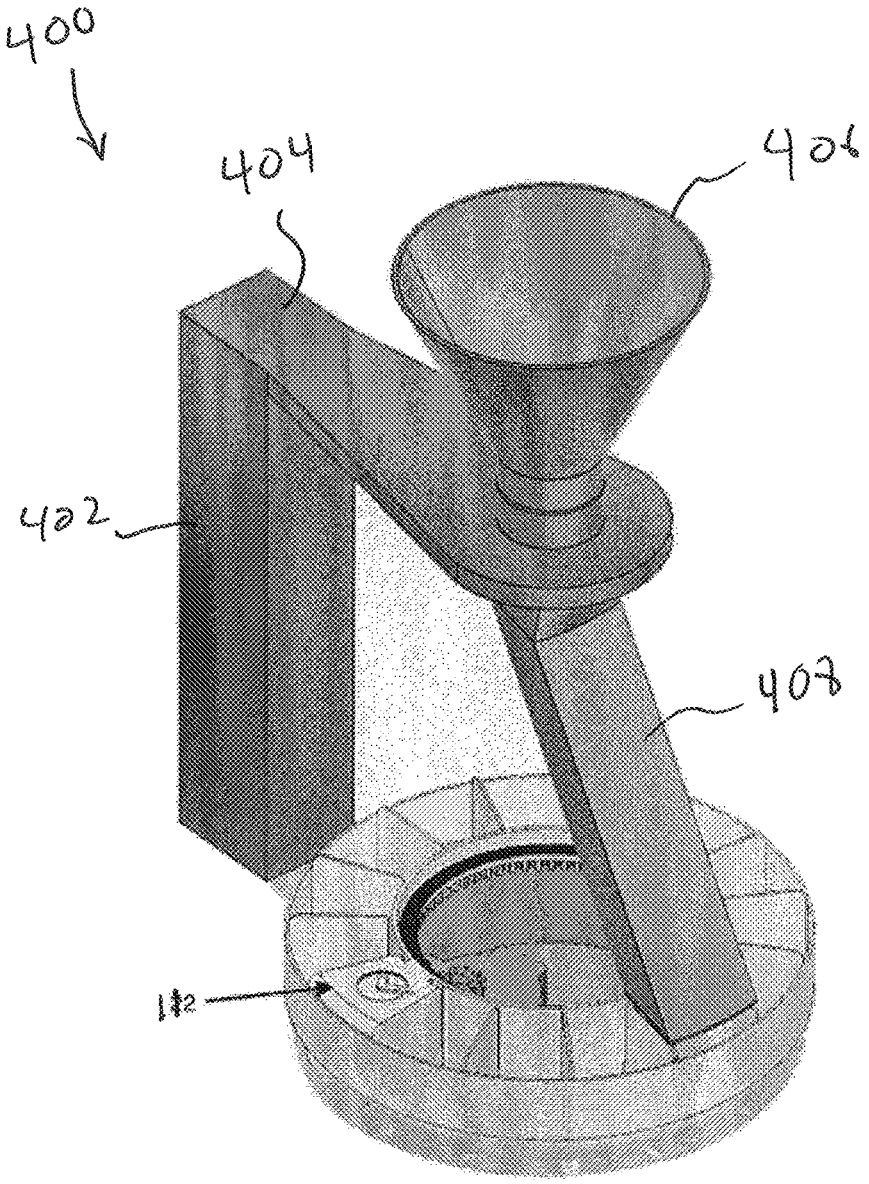
FIG. 9 is a perspective view of an adapter used in loading medication in a dispenser.

In further embodiments, an adapter can be used to assist in loading cassette 112. In FIG. 9, adapter 400 is provided that includes a support member 402 and a cantilever portion 404 supporting a funnel 406. Funnel 406 can be communicatively coupled with a selected compartment 114 through a chute 408. Relative motion between the chute 408 and the cassette 112 can be obtained through rotation of the cassette 112 with respect to the chute 408 (e.g., through operation of drive member 120) or through rotation of chute 408 with respect to cantilever portion 404 (e.g., through manual rotation of the chute 408 or through a suitable drive mechanism). As directed by a medication schedule, a user can position medications within funnel 406 and provided through chute 408 to a corresponding one of the compartments 114.

Figure 10:
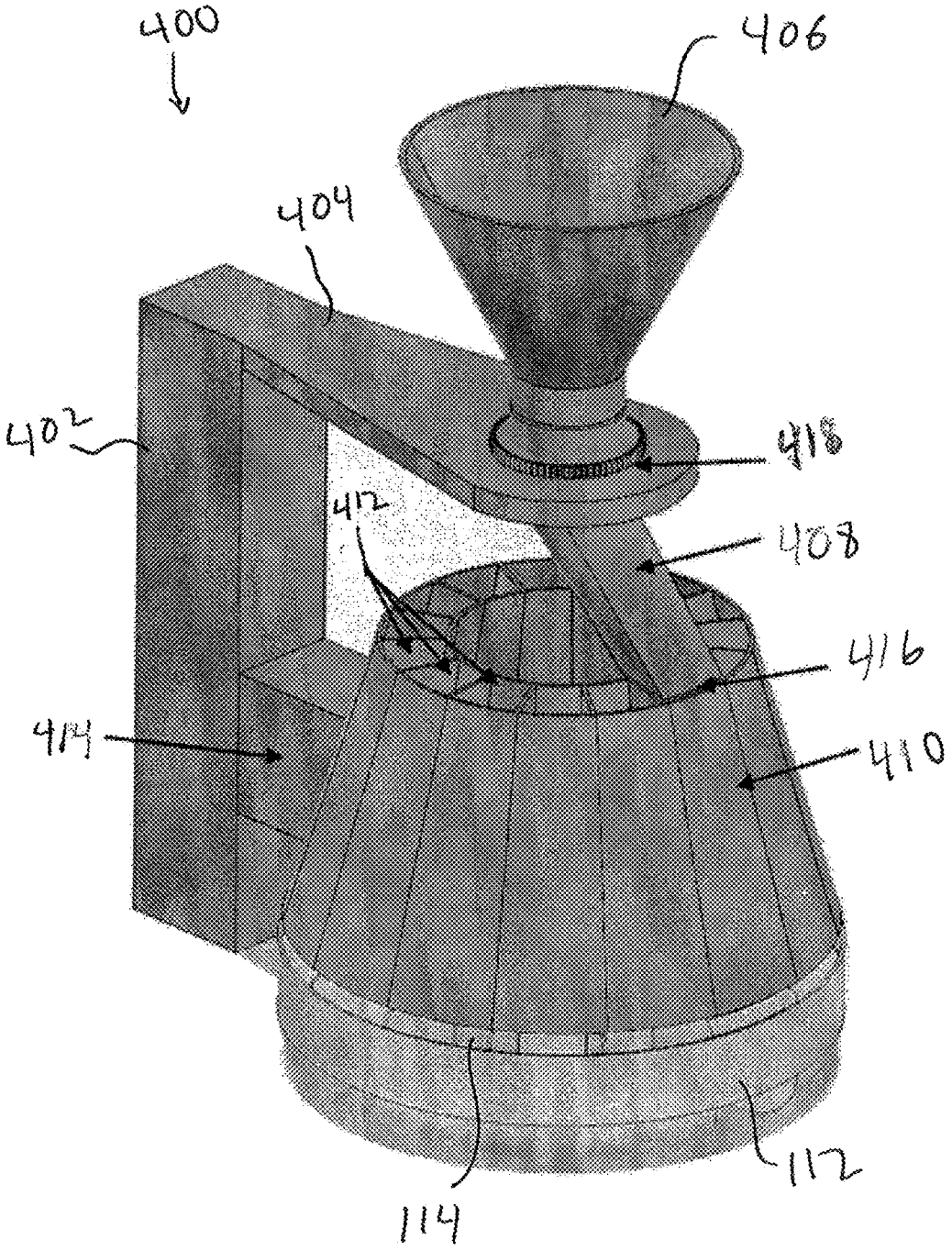
FIG. 10 is a perspective view of an alternative adapter used in loading medication in a dispenser.

In yet a further embodiment, illustrated in FIG. 10, adapter 400 includes similar components to adapter 400 illustrated in FIG. 9. Chute 408 in FIG. 10 is shortened and an extension member 410 includes a plurality of extension conduits 412 that lead directly to the compartments 114 of cassette 112. In this particular embodiment, support member 402 further includes a transverse brace 414 to add additional support to extension member 410. An outlet end 416 of the chute 408 can be adjusted by a gear mechanism 418 (e.g., driven by hand or mechanically) as desired to a selected extension conduit 412.

Various embodiments of the invention have been described above for purposes of illustrating the details thereof and to enable one of ordinary skill in the art to make and use the invention. The details and features of the disclosed embodiment[s] are not intended to be limiting, as many variations and modifications will be readily apparent to those of skill in the art. Accordingly, the scope of the present disclosure is intended to be interpreted broadly and to include all variations and modifications coming within the scope and spirit of the appended claims and their legal equivalents.

The invention claimed is:

1. A method of loading a medication dispenser, comprising:

providing a housing including a base and a cover;

positioning a cassette within the base, the cassette including a plurality of compartments, each compartment configured to hold medication and dispense the medication through a first aperture in the cover when aligned therewith;

obtaining a medication schedule from memory in a control assembly that corresponds to medication to be loaded in each of the plurality of compartments and a time that each compartment should be aligned with the first aperture;

selecting a medication to be positioned within a selected number of the plurality of compartments;

displaying on a display screen using the control assembly an indication of whether the selected medication should be positioned within each of the plurality of compartments based on the selected medication and the medication schedule, the display screen being positioned within the housing and intersecting an axis of rotation of the cassette about the housing; and assembling the cover to the base, the cover including a second aperture aligned with the display screen.

2. The method of claim 1, wherein the indication comprises a representation of each of the plurality of compartments adjacent to each of the plurality of compartments and a designation identifying if the selected medication should be positioned in each of the compartments.

3. The method of claim 1, wherein assembling the cover to the base includes rotatably coupling the cover with the base.

4. The method of claim 1, wherein the display screen includes a touch screen interface.

5. The method of claim 1, wherein the cassette includes an inner ring and an outer ring, and wherein each compartment is defined by opposed sidewalls extending between the inner ring and the outer ring.

6. The method of claim 5, wherein each of the sidewalls defines a slot adjacent to the inner ring, the slot configured to maintain a ribbon providing an identifier for each compartment.

7. The method of claim 5, wherein the cassette includes a notch configured to interface with the drive member.

8. A medication dispenser, comprising:

a housing including a base and a cover;

a cassette rotatably disposed in the housing and including a plurality of compartments, each compartment configured to hold medication and dispense the medication through a first aperture in the cover when aligned therewith;

a control assembly positioned within the housing, the control assembly including memory containing a medication schedule corresponding to medication to be stored in each compartment and a time of day that each compartment should be aligned with the first aperture;

a drive member coupled with the control assembly and configured to rotate the cassette about a central axis to align each compartment with the first aperture based on the medication schedule; and a display screen positioned within the housing, aligned with a second aperture in the cover and intersecting the central axis, wherein the display screen is configured to provide an indicator for each of the plurality of compartments indicative of medications to be positioned within each of the plurality of compartments.

9. The medication dispenser of claim 8, wherein the indicator comprises a representation of each of the plurality of compartments and a designation identifying if a selected medication should be positioned in each of the compartments.

10. The medication dispenser of claim 8, wherein the cover is rotatably coupled with the base.

11. The medication dispenser of claim 8, wherein the display screen includes a touch screen interface.

12. The medication dispenser of claim 8, wherein the cassette includes an inner ring and an outer ring, and wherein each compartment is defined by opposed sidewalls extending between the inner ring and the outer ring.

13. The medication dispenser of claim 12, wherein each of the sidewalls defines a slot adjacent to the inner ring, the slot configured to maintain a label providing an identifier for each compartment.

14. The medication dispenser of claim 12, wherein the cassette includes a notch configured to interface with the drive member.

* * * * *